United States Patent [19]

Vornholt

[11] Patent Number: 4,790,254

[45] Date of Patent: Dec. 13, 1988

[54] BEARDED NEEDLE FOR BOOKBINDING AND EMBROIDERY MACHINES

[75] Inventor: Harry Vornholt, Bitz, Fed. Rep. of Germany

[73] Assignee: Theodor Groz & Soehne & Ernst Beckert Nadelfabrik Commandit-Gesellschaft, Albstadt Ebingen, Fed. Rep. of Germany

[21] Appl. No.: 147,163

[22] Filed: Dec. 14, 1987

[30] Foreign Application Priority Data

Dec. 13, 1986 [DE] Fed. Rep. of Germany ..... 3642693

[51] Int. Cl.[4] ..... D05B 85/04

[52] U.S. Cl. ..... 112/222; 66/119; 223/102

[58] Field of Search ..... 112/222, 223; 223/102; 66/119

[56] References Cited

U.S. PATENT DOCUMENTS

| | | | |
|---|---|---|---|
| 2,633,721 | 4/1953 | Schoenster | 66/119 |
| 3,834,599 | 9/1974 | Herr | 112/222 |
| 3,922,982 | 12/1975 | Conti | 112/222 |

FOREIGN PATENT DOCUMENTS

| | | |
|---|---|---|
| 642703 | 3/1937 | Fed. Rep. of Germany . |
| 2440306 | 3/1975 | Fed. Rep. of Germany . |

OTHER PUBLICATIONS

DIN Deutsches Institut für Normung e.V., German Standard DIN 5330, Jan. 1977.

*Primary Examiner*—Andrew M. Falik

*Attorney, Agent, or Firm*—Spencer & Frank

[57] ABSTRACT

A bearded needle for bookbinding machines, embroidery machines and other similar machines comprising a needle shank having a neck portion, a beard, and a needle head supporting the beard. The needle head is connected to the neck portion and has an essentially conical needle tip. The beard and the shank are connected to the needle head to form a needle eye having a rounded fillet at the side of the eye facing the needle tip. The needle tip has a portion in a region of the fillet which has an upright essentially rectangular configuration with rounded edges and two narrow sides each having a center with the longitudinal plane of symmetry intersecting the centers of the narrow sides. The needle head at least in a region of the needle eye has a first laterally smooth taper thereby forming a thread travel area on each side of the longitudinal plane of symmetry.

11 Claims, 3 Drawing Sheets

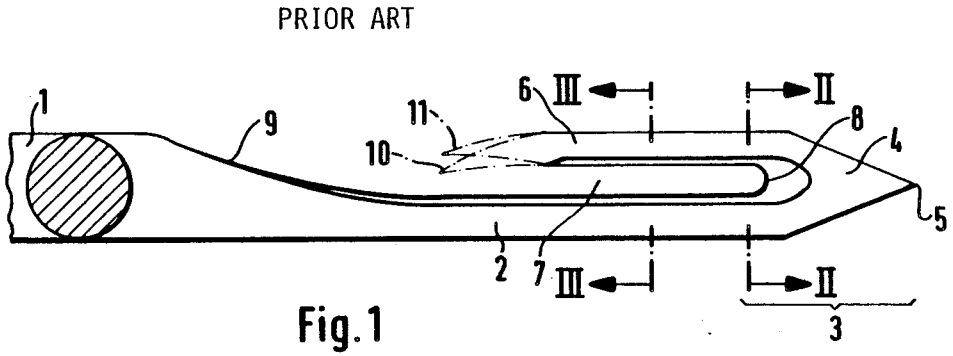
Fig. 1
Fig. 2
Fig. 3
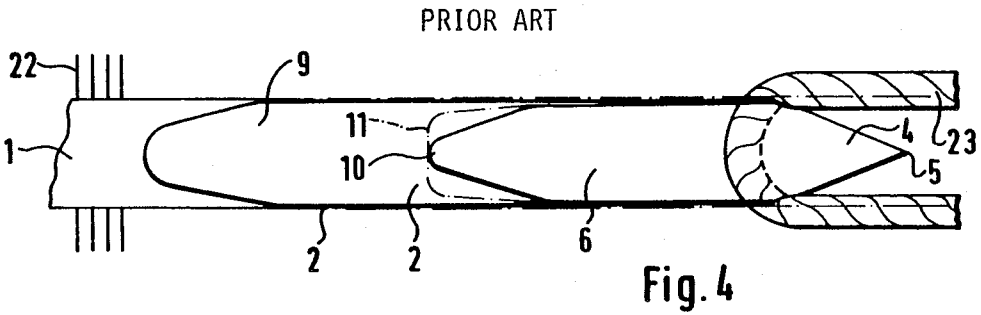
Fig. 4

BEARDED NEEDLE FOR BOOKBINDING AND EMBROIDERY MACHINES

BACKGROUND OF THE INVENTION

1. Field of the Invention

The present invention relates to a bearded needle for bookbinding stitching machines, embroidery machines and other similar machines. The needle includes a needle shank followed by a crimp or neck portion and a needle head which has an essentially conical needle tip. The needle head supports a beard which, together with the shank portion, forms the needle eye. The needle eye on the side facing the needle tip, is delimited by a rounded fillet.

2. Discussion of the Prior Art

Bearded needles are used to pull a threaded loop through a workpiece and for example the workpiece may be the pages of a book to be sewn together. German Pat. No. 642,703 discloses a conventional configuration where the operation of a bookbinding stitching machine operating with bearded needles is briefly described. In principle, bearded needles are used in such a manner that the previously perforated or unperforated workpiece is pierced by them until their beard is exposed on the other side and is able to catch a thread which is then pulled in the form of a loop through the workpiece. In particular, if the workpiece is hard as in the case of a book where the pages are stitched together, the thread is subjected to considerable stress when the loop is pulled through the workpiece. The prior art bearded needles develop high frictional forces between the thread and the paper resulting in considerable stresses in the region of the needle tip. The result of these stresses is damage to the thread which adversely affects the stability of the stitching. In embroidery machines, these stresses also produce a sloppy appearance of the finished workpiece. The difficulties naturally become greater as the operating speed of the bearded needles become greater to a point where the thread may even break. Consequently the operating speed is limited by the stress on the thread.

SUMMARY OF THE INVENTION

It is therefore an object of the present invention to overcome the drawbacks of the prior art and provide a bearded needle which ensures a substantially gentle treatment of the thread while the threaded loop is being pulled through the workpiece. This permits processing of lower quality thread material and th realization of high operating speeds.

The above and other objects are accomplished by the invention in which a bearded needle for bookbinding machines, embroidery machines and other similar machines comprises a needle shank having a neck portion, a beard, and a needle hea supporting the beard. The needle head is connected to the neck portion and has an essentially conical needle tip. The beard and the shank are connected to the needle head to form a needle eye having a rounded fillet at the side of the ey facing the needle tip. The needle tip has a portion in a region of the fillet which has an upright essentially rectangular configuration with rounded edges and two narrow sides each having a center with the longitudinal plane of symmetry intersecting the centers of the narrow sides. The needle head at least in a region of the needle eye has a first laterally smooth taper thereby forming a thread travel area on each side of the longitudinal plane of symmetry.

With the needle head of the bearded needle of the present invention, optimum protection of the thread is ensured when the threaded loop is pulled through the workpiece. The two portions of the threaded loop which are on both sides of the fillet lie protected within the thread traveling areas. They are not pressed laterally against the material of the workpiece when the threaded loop is pulled through and thus practically no friction forces are developed between the threaded material and the workpiece. The thread travel areas are matched to the thickness of the thread material and have sufficient depth that the two parts of the threaded loop are able to move back laterally with respect to the circumference of the crimp or shank of the needle forming the hole when the workpiece is pierced. The result of retraction of the bearded needle through the hole in the workpiece permits th threaded loops to be pulled through without interference.

It has been found in practice to be particularly advantageous if the lateral taper of the needle head between the fillet or the needle shank and the end of the needle tip on each side of the longitudinal plane of symmetry is at least one quarter of the needle shank diameter. It has also been found to be favorable for the needle head to be laterally concavely tapered in the region of the fillet of the needle eye portion. To impart greater stability to the needle tip, particularly when hard workpieces are to be pierced, it may be advisable for theneedle tip to have a region of essentially uniform width which starts at its end. The end of the needle tip ma then be configured as a cutting edge or cone tip which lies in the longitudinal plane of symmetry of the needle.

To form longitudinally extending thread guide grooves beginning at the fillet, the needle tip may be hollow ground on its sides. These grooves improve guidance of the threaded loop without unnecessarily weakening the needle.

It may also be advantageous for the crimp of the needle to be laterally tapered beginning in the region before the end of the beard toward the needle tip on both sides of the longitudinal plane of symmetry. A second taper may also be provided which follows this first taper in the form of the lateral taper of the needle head. In this way, the necessary thread travel area is divided into two sections of the needle head and the needle crimp. These sections lie one behind the other in the longitudinal direction of the needle, thus avoiding too abrupt a taper in the needle head which is inappropriate for various uses. In the region ahead of the second taper and toward the tip of the needle, the tapered crimp may have essentially the same width. This same width is an advantage helping the stability of the needle.

Finally, it is preferable for the beard end of the needle to be bent slightly toward the crimp s as to prevent the threaded loop from slipping out of the needle eye as well as to avoid stitching errors and hooking into the workpiece. Moreover, this beard facilitates adjustment to a given needle eye opening.

BRIEF DESCRIPTION OF THE DRAWINGS

FIG. 1 is a side view of a bearded needle according to the prior art for a bookbinding stitching machine.

FIGS. 2 and 3 are sectional views along lines II—II and III—III, respectively, of the bearded needle of FIG. 1.

FIG. 4 is a sectional top view of the bearded needle of FIG. 1 with the associated threaded loop.

DESCRIPTION OF THE PREFERRED EMBODIMENTS

Figure 7:
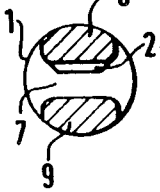

FIGS. 1 to 4 and 9 show the prior art bearded needle. These correspond approximately to the embodiment disclosed in FIGS. 7 and 8 of German Pat. No. 642,703. The bearded needle includes a needle shank 1 having a circular cross-sectional configuration. The needle shank 1 has a clamp-in or screw-in member (not shown) and is followed, by way of a crimp or neck portion 2 by a needle head 3 which has an essentially conical needle tip 4. The needle tip 4 has a pointed end which is considered the actual "tip" and is marked 5. Needle head 3 has a shaped-on beard 6 which, together with the upper side of crimp 2, forms the needle eye 7. On the side facing the needle tip 4 the needle eye 7 is delimited by a rounded fillet 8. Crimp 2 is recessed with respect to the upper side of the needle shank by way of a needle breast region 9. Therefore the upper edge of beard 6 is flush with the upper side of the needle shank or is slightly set back with respect thereto. The underside of the needle shank forms a straight line extending uninterruptedly over crimp 2 to needle tip 4.

The end of beard 6 at I0 is inclined slightly inwardly toward crimp 2. The opening width of the otherwise essentially parallel sided needle eye 7 is dimensioned so that a thread associated with this size needle is able to slide smoothly through eye 7. As can be seen in FIG. 4, the end of beard 6 is slightly pointed at its sides, but there also exist other embodiments where beard 6 is only slightly tapered at its end, as indicated in dot-dash lines at 11. Here the remaining portion of beard 6 has essentially the same width as crimp 2.

FIGS. 5 to 8 and 10 show the bearded needle according to the present invention, with the same or corresponding parts bearing the same reference numerals. Insofar as they coincide with the features of the embodiments of FIGS. 1 to 4, these features are not described again.

Beginning at 12 in the region of needle eye 7, the needle head 3 is configured to laterally taper without interruptions on both sides of a longitudinal plane of symmetry of the needle indicated at 13. Two thread travel areas 14 are formed on both sides of longitudinal plane of symmetry 13. In the region of fillet 8 of the needle eye 7, the conical needle tip 4 has an essentially rectangular cross-sectional configuration shown in FIG. 6. The edges 15 are rounded and the narrow sides 16 are intersected in the center by the longitudinal plane of symmetry 13. The lateral taper of needle head 3 between fillet 8 and end 5 of needle tip 4 on each side of longitudinal plane of symmetry 13 is at least one quarter of the diameter of cylindrical needle shank 1, whose cross-sectional configuration is indicated at 17. The two mentioned lateral tapers in needle head 3 are located in the region of fillet 8 and are provided with concave wall regions 18 which change to a region 19 of essentially the same width. The end 5 of needle tip 4 is configured as a cutting edge or a conical tip lying in the longitudinal plan of symmetry 13 of the needle (see FIG. 5).

Figure 5:
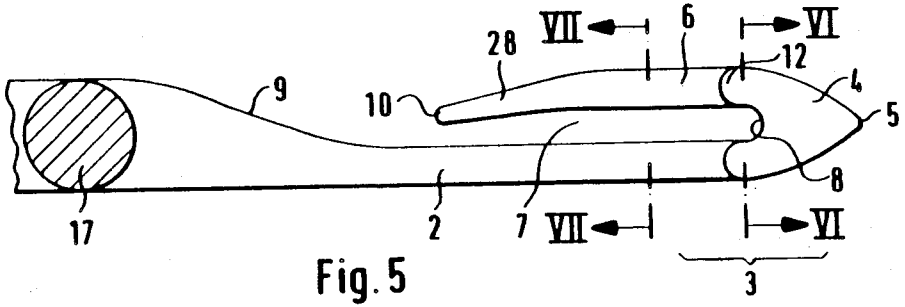
FIG. 5 is a side view of the bearded needle according to the present invention.
Figure 6:
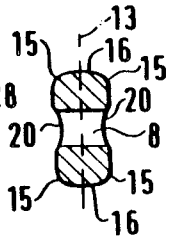
FIGS. 6 and 7 are longitudinal sectional views along lines VI—VI and VII—VII, respectively, of the bearded needle of FIG. 5.

As can be seen in FIG. 6, the needle tip 4 is ground on the sides to form longitudinally extending thread guiding grooves 20 which start at fillet 8.

In contrast to the embodiment according to FIGS. 1 to 4, crimp 2 is laterally tapered at 21 toward needle tip 4 in region 21. The region 21 begins in the region before the end 10 of beard 6 and is located on both sides of the longitudinal plane of symmetry 13 so that this lateral taper is followed by the already described lateral taper of needle head 3 at 14. In the region ahead of the taper at 14, the crimp 2 has essentially the same width. (See FIG. 8.)

Finally, the end of beard 6 has a section 28 which is slightly bent toward crimp 2 to ensure more secure retention of the thread in needle eye 7.

In operation the bearded needle is pushed with its needle tip 4 through the workpiece 22, which may be the stacked pages of a book for example, until the cylindrical needle shank 1 passes through workpiece 22 This produces a cylindrical hole in workpiece 22 whose shape is defined by the cross-sectional configuration 17 of the needle shank.

Figure 9:
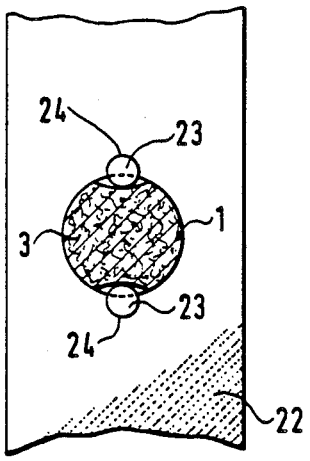
PRIOR ART Fig. 9
FIG. 9 is a sectional view along line II—II of the prior art bearded needle of FIG. 1, showing the workpiece and the inserted threaded loop as it is being pulled through the workpiece.
Figure 10:
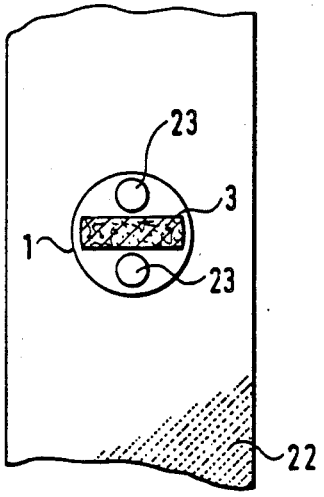
FIG. 10 is a sectional view along line VI—VI of FIG. 5 showing the bearded needle and the workpiece according to the invention.

A thread 23 is placed into the needle eye 7 of needle head 3 which projects beyond workpiece 22. With the returning movement of the bearded needle, the thread 23 is pulled out in the form of an essentially U-shaped thread loop which is pulled through workpiece 22. FIGS. 9 and 10 illustrate that the stress conditions for thread 23 are different in the prior art bearded needle shown in FIGS. 1 to 4 than in the bearded needle according to the invention shown in FIGS. 5 to 8.

In the prior art bearded needle, the thread 23 of the U-shaped threaded loop is pressed together at 24 to the sides of the edges of the prepunctured hole in workpiece 22 and needle head 3 in the region of fillet 8. The thread 23 is also forced in part to locally widen the opening in workpiece 22 made by needle shank 1. The result is that thread 23 is subjected to high frictional stresses when it is pulled through workpiece 22 which may lead to excess tensile stress on the threaded loop in the region of fillet 8 as well as to damage or even breakage of the thread 23.

Figure 8:
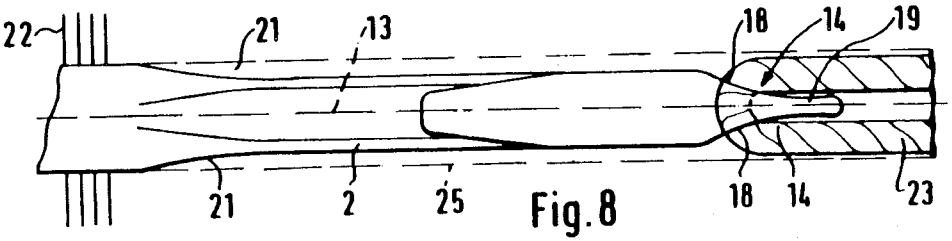
FIG. 8 is a top view of the bearded needle of FIG. 5.

In contrast thereto, the bearded needle according to th invention and shown in FIG. 10 illustrates that the two arms of the threaded loop which are pulled through the opening lie in thread travel areas 14 and in any case within the outline of cylindrical needle shank 1 which is shown by the dot-dash lines 25 in FIG. 8. The result is that the thread of the threaded loop is not impeded by friction from workpiece 22 but is pulled through the prepunctured hole freely and smoothly. The tensile force exerted o thread 23 of the threaded loop is produced essentially by the thread tension given by the thread supplying device and possibly by a slight inherent spring-back elasticity of the edge of the hole in workpiece 22. The rectangular cross-sectional configuration of needle head 3 is that of a flat land which leaves sufficient play for movement in the thread guiding areas 14 on both sides.

Alternatively, the lateral taper shown at 21 in FIG. 8 may also be omitted. The width of needle eye 7 approximates the thickness of a thread 23 associated with the respective needle size and is selected to be slightly larger to ensure free movement of the thread 23.

After the threaded loop has been pulled through, workpiece 22 rotates the bearded needle 90° about its axis so as to permit the gripper free access through the thread loop as is generally required. Therefore, thread guide grooves 20 are oriented approximately axially parallel to one another. However, embodiments are also conceivable in which needle head 3 and thread g idance grooves 20 are helically twisted to eliminate the need for rotation of the bearded needle after it has been pulled through workpiece 22 as described in German Pat. No. 642,703.

All edges and junctions in the thread guiding region, i.e. in the region of needle eye 7, fillet 8 and needle tip 4 are perfectly rounded which also applies for beard 6. The fillet surface and all transitions in the region of fillet 8 are highly polished and free of any evidence of working. This has an advantageous influence on the flow of the thread 23 and the stability of the needle. The two guide grooves 20 produce proper influx into fillet 8 while simultaneously ensuring that there is a sufficiently large space for movement of the thread 23 without unnecessarily weakening the needle.

As can be seen in FIG. 6, needle head 3 which has an essentially rectangular cross section is rounded at edges 15, alternatively, the edges 15 may be chamfered.

As shown in FIG. 10, the height of needle head 3 measured in the longitudinal plane of symmetry 13 may be somewhat smaller than the diameter of cylindrical needle shank 1. This means that the height of needle head 3 may be somewhat smaller than the maximum height of the needle shank with the result being that needle head 3 is also able to pass essentially u impeded through the hole in workpiece 22 prepunched by needle shank 1.

The present disclosure relates to the subject matter disclosed in German Pat. No. 36 42 693.8 of Dec. 13, 1986, the entire Specification of which is incorporated herein by reference.

It will be understood that the above-description of the present invention is susceptible to various modifications, changes and adaptations, and the same are intended to be comprehended within the meaning and range of equivalents of the appended claims.

What is claimed is:

1. A bearded needle having a longitudinal plane of symmetry for bookbinding machines, embroidery machines and other similar machines comprising:

a needle shank having a neck portion;

a beard;

a needle head supporting said beard, being connected to said neck portion and having an essentially conical needle tip; and wherein said beard and said shank are connected to said needle head to form a needle eye having a rounded fillet at the side of said eye facing said needle tip, said needle tip having a portion in a region of the fillet which has an upright essentially rectangular configuration with rounded edges and two narrow sides each having a center, the longitudinal plane of symmetry intersects the centers of said narrow sides, and said needle head at least in a region of the needle eye has a first laterally smooth taper thereby forming a thread travel area on each side of the longitudinal plane of symmetry.

2. A bearded needle as defined in claim 1, wherein said needle tip includes an end and said needle shank has a diameter, and said needle head has a thickness in the region of said first taper which is at least one quarter of said diameter of said needle shank between the fillet and said end of said needle tip.

3. A bearded needle as defined in claim 1, wherein said first taper of said needle head is laterally concavely tapered in said region of the fillet.

4. A bearded needle as defined in claim 1 wherein said needle tip includes an end and said needle tip has a region of essentially uniform width beginning at said end of said needle tip.

5. A bearded needle as defined in claim 4, wherein said end of said needle tip is configured as a cutting edge disposed in the longitudinal plane of symmetry.

6. A bearded needle as defined in claim 4, wherein said end of said needle tip is configured as a conical tip.

7. A bearded needle as defined in claim 1, wherein said needle tip further includes longitudinally extending thread guiding grooves beginning at the fillet.

8. A bearded needle as defined in claim 1, wherein said shank includes a second lateral taper adjacent said neck portion.

9. A bearded needle as defined in claim 8, wherein said neck portion has an essentially constant width between said first and second tapers.

10. A bearded needle as defined in claim 1, wherein said beard includes an end which is slightly bent toward said neck portion.

11. A bearded needle as defined in claim 1, wherein said needle head has a height measured in the longitudinal plane of symmetry, said needle shank has a maximum height, and said height of said needle head is less than said maximum height of said needle shank.

* * * * *